US006505350B2

(12) United States Patent
Litke

(10) Patent No.: US 6,505,350 B2
(45) Date of Patent: Jan. 14, 2003

(54) GLOVE WITH REMOVABLE FASTENER MATERIAL

(75) Inventor: Kenneth S. Litke, Marion, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/836,275

(22) Filed: Apr. 18, 2001

(65) Prior Publication Data

US 2002/0152537 A1 Oct. 24, 2002

(51) Int. Cl.[7] ..... A41D 19/00
(52) U.S. Cl. ..... 2/161.4
(58) Field of Search ..... 2/161.2, 161.4, 2/160, 161.1; 36/96, 72, 71.5; 40/586

(56) References Cited

U.S. PATENT DOCUMENTS 3,274,616 A 9/1966 Russo ..... 2/161
3,918,097 A 11/1975 Mlodoch ..... 2/161
4,905,321 A 3/1990 Walunga ..... 2/161
5,156,399 A 10/1992 Gauer ..... 273/187
6,058,577 A * 5/2000 Ida et al. ..... 24/306

FOREIGN PATENT DOCUMENTS

GB 2 329 216 A 3/1999

* cited by examiner

*Primary Examiner*—Rodney M. Lindsey
*Assistant Examiner*—James G Smith
(74) *Attorney, Agent, or Firm*—Swidler Berlin Shereff Friedman, LLP

(57) ABSTRACT

The present invention is directed to a glove having a removable and interchangeable fastener material. The fastener material is attachable to the glove body by first and second attachment members that are prevented from contacting a wearer's skin by an extended portion of the fastener material that extends over and substantially beyond the attachment members. The fastener material can be provided in sets with different designs.

12 Claims, 12 Drawing Sheets

GLOVE WITH REMOVABLE FASTENER MATERIAL

FIELD OF THE INVENTION

The present invention relates to a glove, and more particularly, to a golf glove having a removable and interchangeable fastener material.

BACKGROUND OF THE INVENTION

Many golf gloves have a slit or opening in the wrist area to allow a wearer to easily slide the glove over their hand or to take it off. A lower piece of hook-and-loop type fastener material, such as VELCRO®, or other type of fastener is typically sewn on one side of the slit, while a cooperating upper piece of fastener material is sewn on the other side of the slit. The upper piece overlies and connects to the lower piece to adjustably close the slit to secure the glove onto the wearer's wrist. In the past, the upper piece has been attached to the glove by sewing it directly to the material of the glove body so that it is not removable.

The upper piece generally bears an emblem or logo on the uppermost surface. The emblems or logos displayed on these are not limited to the manufacturer's marks, but also include those of groups or organizations, such as the wearer's favorite sports team or league. Thus, different individuals or groups of individuals may desire their own, unique design on the upper piece of material. Additionally, golfers may wish to vary the design displayed on this piece so as to coordinate with their outfit or to correspond with an event in which they are playing. This typically requires the user to buy different gloves with different logos, which can be expensive.

While golf glove bodies are typically manufactured by mass production, the upper pieces bearing different emblems, logos, or designs must be manufactured on a custom basis based on the users' individual orders. Since these pieces are typically sewn to the glove bodies simultaneously with the manufacture of the glove bodies, production of the glove bodies cannot begin until the upper pieces are completed. Thus, a common problem in manufacturing golf gloves is that the upper pieces and the glove bodies cannot be manufactured simultaneously and it can often take days for completion of the upper pieces before the glove bodies begin to be mass produced. As a result, the final assembly of the gloves is often delayed, preventing optimum manufacturing time.

One solution to this problem is disclosed in U.S. Pat. No. 6,058,577 to Ida et al., which discloses an attachment structure for attaching a fastener member to the wrist of a glove body. As shown in FIGS. 1 and 1A, the fastener member of the 577 patent ends at or before the left edge of the attachment device, and the attachment device can contact the wearer's skin and cause discomfort. As shown in FIG. 1A, because the fastener member ends at or before the left edge of the attachment device, the overlap of the fastener member and corresponding fastener material on the glove body is limited and may impair the ability of the glove to securely close over small hands. Therefore, it is desirable to provide a golf glove with a removable upper piece of fastener material that is easy to use, comfortable, and does not limit the adjustability of the glove. The present invention provides such a glove.

SUMMARY OF THE INVENTION

The present invention is directed to a glove having a removable and interchangeable fastener material. The glove includes a body with a slit therein, a first attachment member attached to the body adjacent the slit, and a first piece of material. The first piece of material has a second attachment member attached thereto. The second attachment member is removably attachable to the first attachment member.

The first piece of material optionally has a flap portion and an extended portion. The extended portion extends from a slit side of the first attachment member substantially beyond an interior side of the first attachment member, preferably by at least about 0.25 inches, more preferably by between about 0.25 inches and about 1 inches, and most preferably by at least about 1 inch. The flap portion may fold over the slit.

The first piece of material includes a first fastener piece, and the glove includes a second fastener piece located thereon that me be removably affixed to the first fastener piece. Preferably, the flap portion and the extended portion are one piece of material.

According to one embodiment, one of the attachment members includes at least one socket and the other attachment member includes at least one socket plug capable of locking engagement with the at least one socket.

According to a different embodiment, one of the attachment members includes a rod oriented substantially parallel to the slit and the other attachment member includes a sleeve slidable with respect to the rod for retaining the members together. These attachment members are rotatable with respect to one another about the rod. Optionally, a stop may be formed on one of the members to block the sleeve from sliding longitudinally along the rod in a predetermined direction.

The present invention is also directed to a glove having a set of removable and interchangeable first pieces with different designs or logos thereon.

DETAILED DESCRIPTION OF THE PREFERRED EMBODIMENTS

Figure 2:
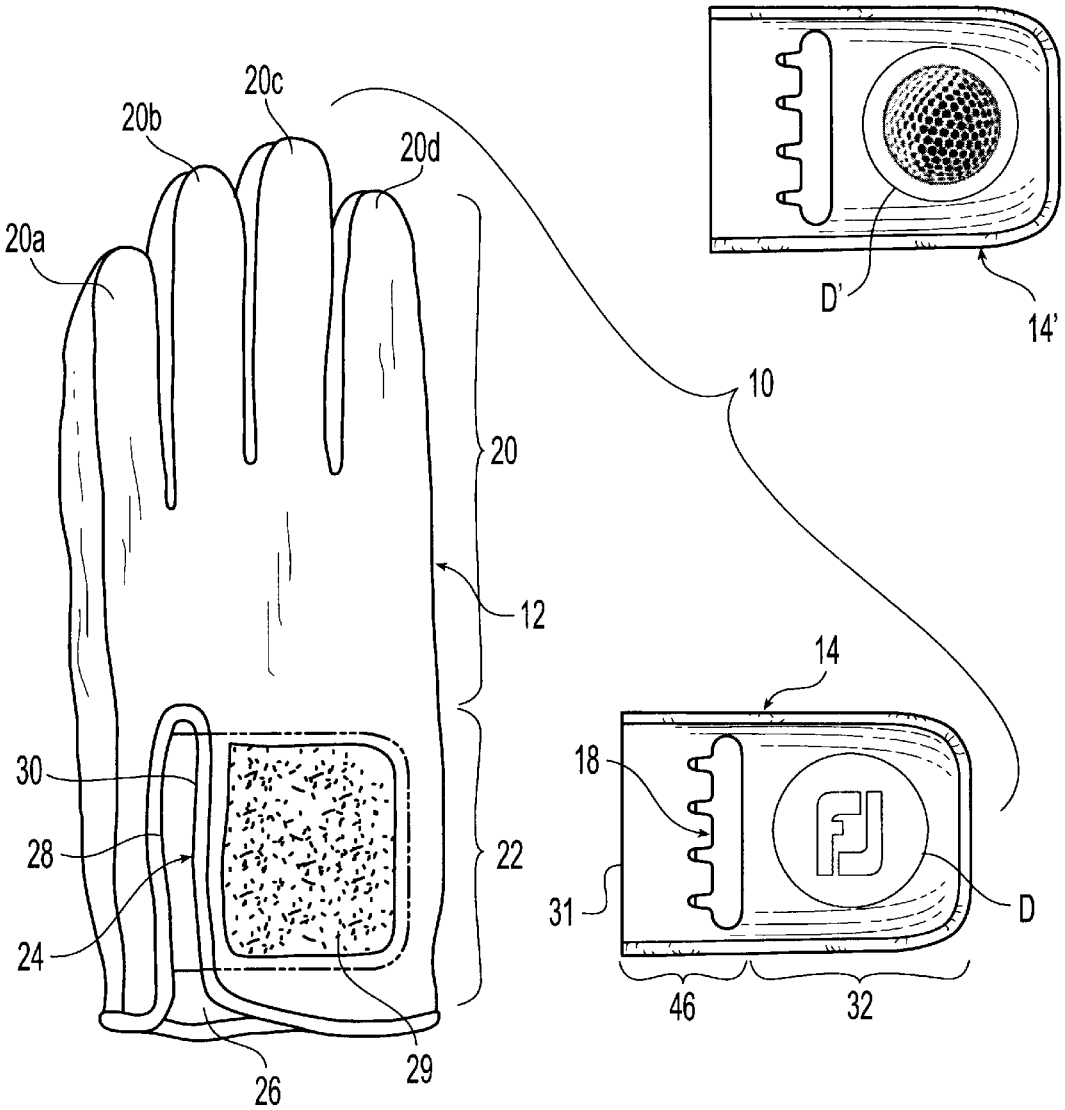
FIG. 2 is an exploded top view of a glove according to a first embodiment of the present invention.

FIGS. 2–7 show a first embodiment of a glove according to the present invention that has a removable and interchangeable fastener material. The glove 10 is shown and described as a golf glove but the present invention is directed to all types of gloves, such as those for driving, skiing, weight lifting, cycling, fashion or winter gloves. Glove 10 includes a glove body 12 and a first piece of material, shown as fastening band or tab 14, removably attachable to glove body 12 by first and second attachment members 16, 18, best shown in FIG. 5. As shown in FIG. 2, a design or logo D may be provided on a surface of tab 14.

Referring to FIG. 2, glove body 12 includes upper portion 20, including four fingers 20*a*–20*d* and a thumb (not shown), and a lower or wrist portion 22. Glove body 12 is preferably of a non-woven material, such as leather or synthetic leather, but one of ordinary skill in the glove art will know and appreciate that any number of different materials may be suitable for glove body 12, such as cotton, wool, natural fibers, synthetic fibers, or blends and combinations thereof. Glove 10 is shown having full length fingers 20*a*–*d*, however the present invention also includes gloves having half-length fingers, no fingers at all, or a single finger stall, such as in mittens.

Still referring to FIG. 2, the wrist portion 22 has a slit 24 therein extending from an open end 26 toward the upper portion 20 of the glove body 12. Slit 24 has a first side 28 and a second side 30. First piece of material, tab 14, can be attached to glove body 12 adjacent the first side 28 of slit 24, and a second piece of material with a second fastener piece 29 may be located on an upper surface of wrist portion 22 adjacent the second side 30 of slit 24.

Figure 1:
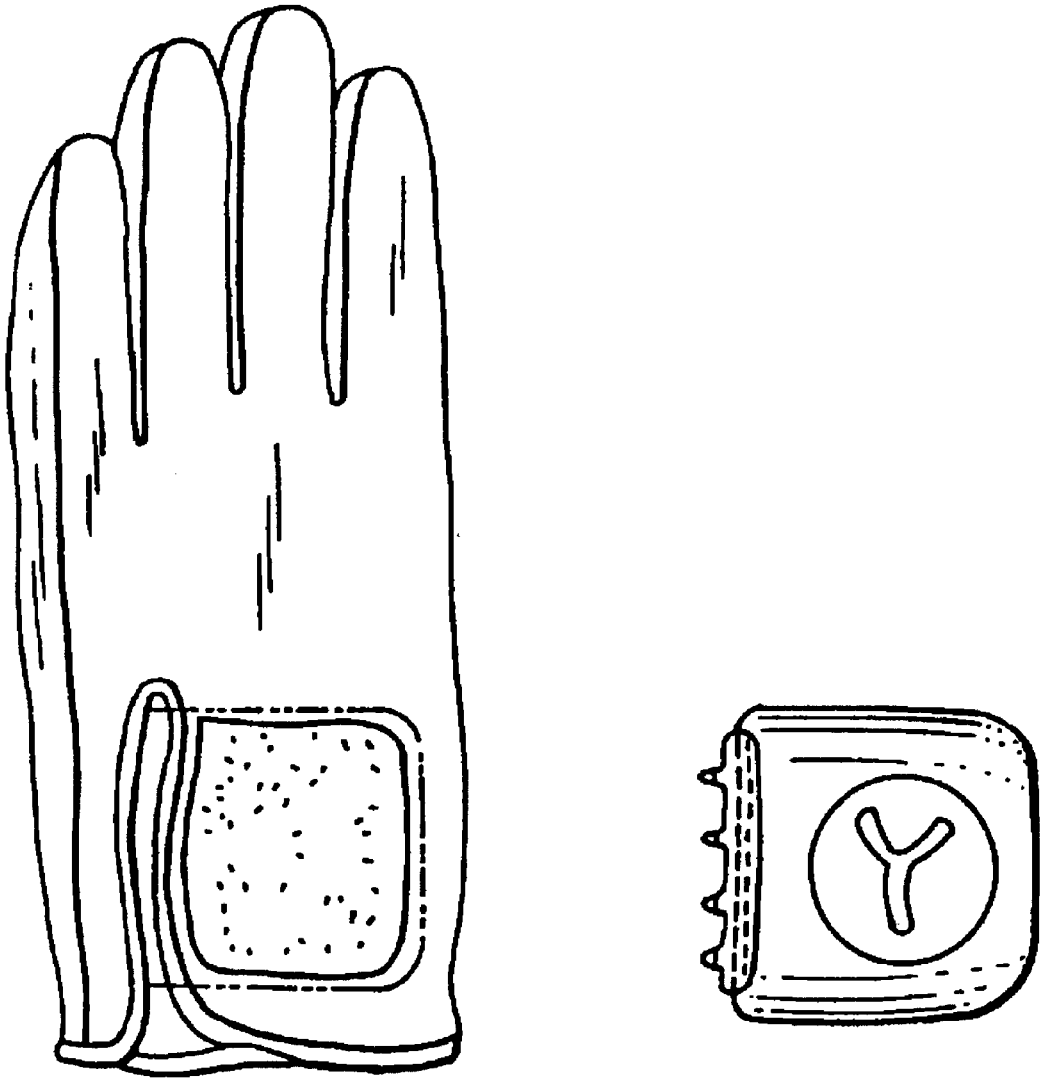
Fig. 1 (Prior Art)
FIG. 1 is an exploded top view of a prior art glove.
Figure 1A:
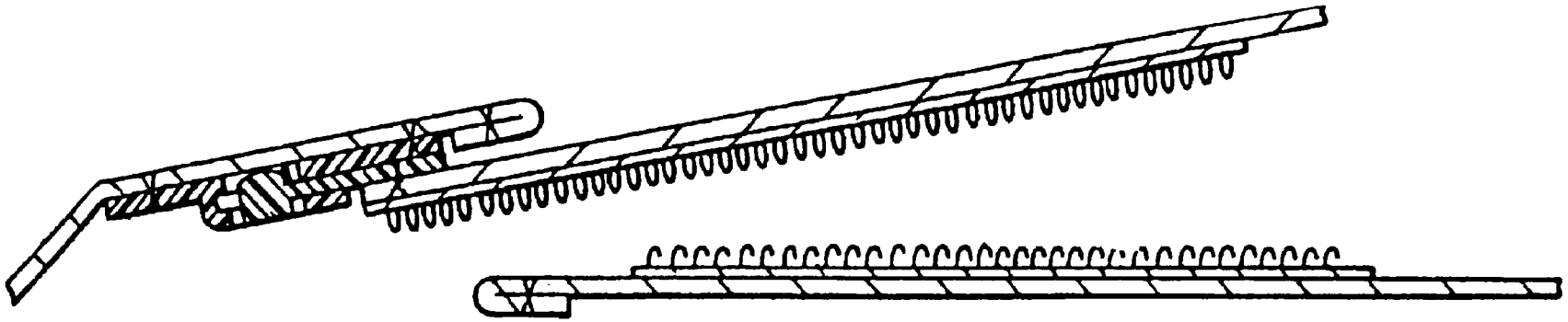
Fig. 1A (Prior Art)
FIG. 1A is cross-sectional view of a portion of the glove and fastener material of FIG. 1.
Figure 3:
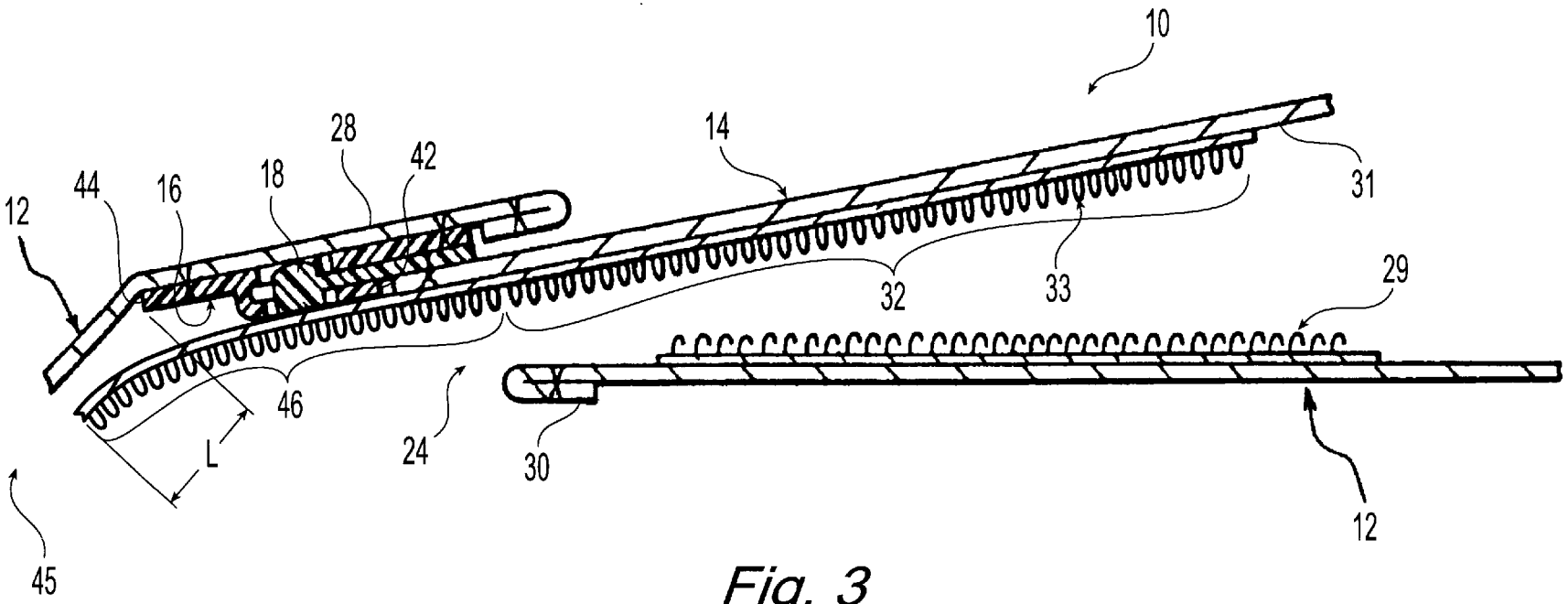
FIG. 3 is a cross-sectional view of a portion of the glove and fastener material of FIG. 2, wherein the fastener material is attached to the glove.

Tab 14 has a flap portion 32 that folds over slit 24 such that a lower surface 31 of flap portion 32 may contact the second side 30 of slit 24. The lower surface 31 of flap portion 32 preferably has a first fastener piece 33 attached thereto, as shown in FIG. 3. The positions of tab 14, slit 24 and second piece of material 29 are not to be limited to the configuration shown in FIG. 1. For example, the positions of tab 14 and second fastener piece 29 may be reversed so that tab 14 is attached adjacent the second side 30 of slit 24, and second fastener piece 29 is attached adjacent the first side 28. In addition, tab 14, slit 24 and second fastener piece 29 can be moved to another area of the glove body 12, such as the lower surface of wrist portion 22.

Figure 4:
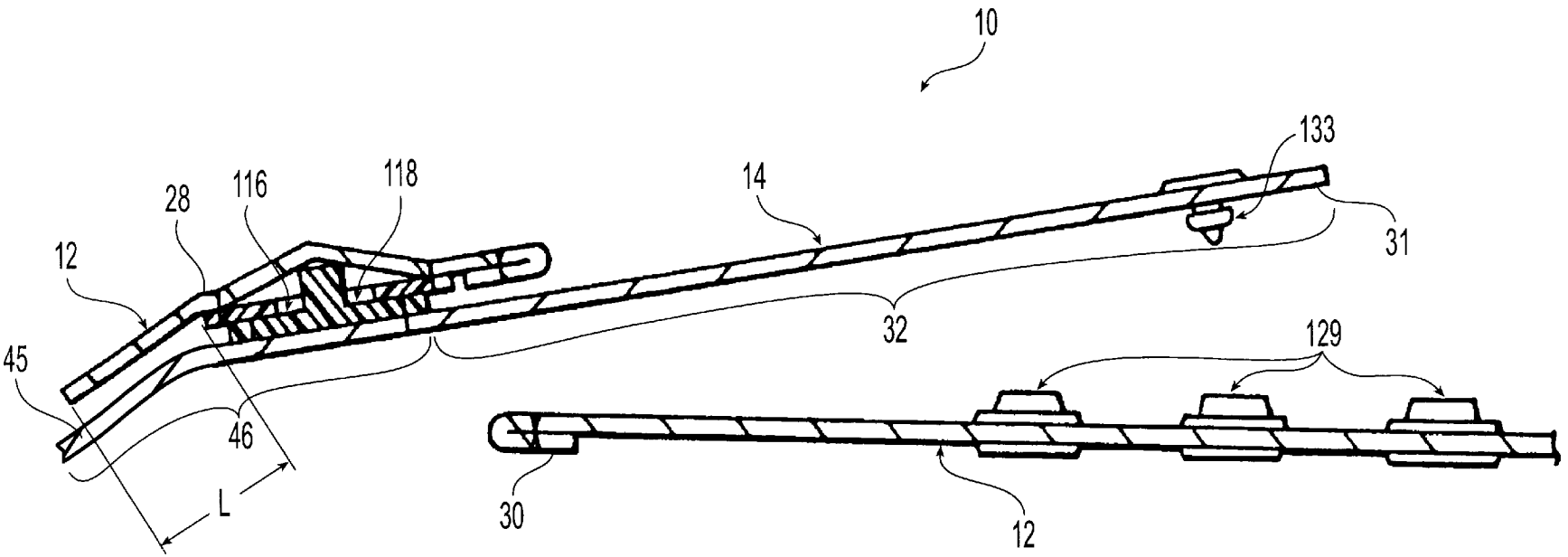
FIG. 4 is a cross-sectional view of a portion of another embodiment of a glove and fastener material.

Referring to FIG. 3, first and second fastener pieces 29, 33 may be cooperating pieces of hook-and-loop type fastener material, such as VELCRO®, that allow the wearer to removably secure flap portion 32 to the second side 30 of wrist portion 22 and thereby open, close, or adjust the wrist portion 22 of the glove 10 around their hand. Alternatively, as shown in FIG. 4, first and second fastener pieces 129, 133 may be cooperating male and female snap members that are disposed at predetermined locations on the lower surface 31 of flap portion 32 and the second side 30 of wrist portion 22. One of ordinary skill in the glove art, however, will know and appreciate than any number of different fastener pieces and configurations of fastener pieces may be used to removably attach flap portion 32 to the second side 30 of wrist portion 22.

Still referring to FIG. 3, a first attachment member 16 is attached to the first side 28 of glove body 12 and a second attachment member 18 is attached to the lower surface 31 of tab 14. First attachment member 16 has a slit side 42 and an interior side 44. Slit side 42 is located more toward slit 24, while interior side 44 is located more toward the interior 45 of glove 10. Tab 14 has an extended portion 46 that extends from the slit side 42 of first attachment member 16, covers first attachment member 16 and then extends substantially beyond the interior side 44 thereof. Tab 14 thus covers the attachment members 16, 18 and at least partially blocks them from contacting the wearer's skin. Extended portion 46 extends beyond the interior side 44 of first attachment member 16 by a length L, which is preferably at least about 0.25 inches, more preferably between about 0.25 and about 1 inches, and most preferably at least about 1 inch. As shown in FIG. 3, extended portion 46 and first fastener piece 33 may be formed of a single piece of hook-and-loop material attached to the lower surface 31 of flap portion 32. This increases the length L of fastener piece 31 and thereby increases the adjustability of the wrist portion 22 of glove 10.

As shown in FIG. 4, tab 14, flap portion 32 and extended portion 46 may all be formed of one piece of material, such as hook-and-loop material. According to an alternate embodiment, extended portion 46 can be a separate piece of material, such as fabric, leather or felt, that is coupled to the glove 10, first attachment member 16, or tab 14 with adhesive or stitching. According to yet another embodiment, extended portion 46 can be layered between the first fastener piece 33 and tab 14, however, one of ordinary skill in the glove art will know and appreciate than any number of different configurations, materials, and attachment techniques may be utilized to form extended portion 46.

Figure 5:
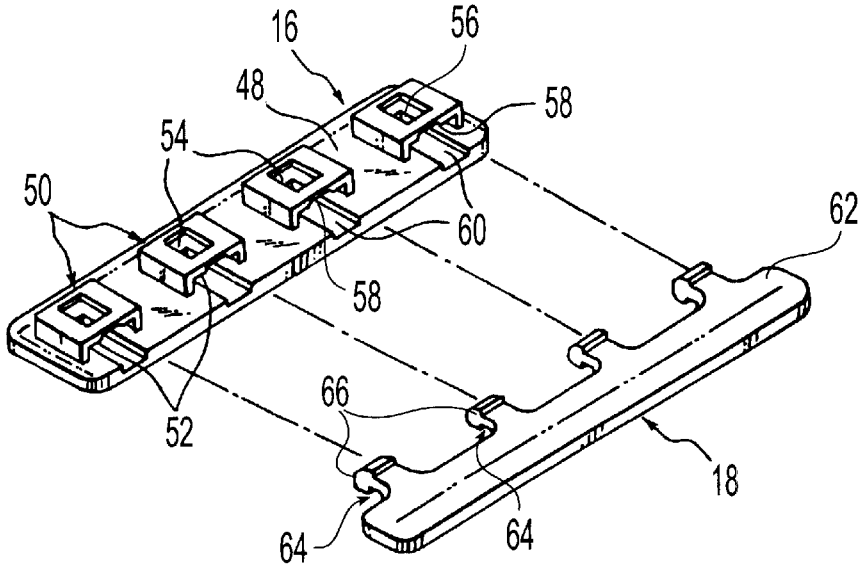
FIG. 5 is an exploded perspective view of first and second attachment members of the glove of FIG. 2.

FIG. 5 shows one embodiment of first and second attachment members 16, 18 that may be molded of thermoplastic synthetic resin, such as polyethylene, polypropylene, polyamide or polyester and are typically attached to the glove body 12 and tab 14 by stitching. Alternatively, the attaching may be accomplished by ultrasonic welding, thermal welding, by adhering with an adhesive, or the like. The first attachment member 16 includes a base plate 48 in the form of a rectangular strip with a plurality of longitudinally arranged sockets 50 projecting therefrom. Each socket 50 is in the form of a hollow, deformable right-angled box having an entrance hole 52, an upper locking hole 54, and a lower locking hole 56 therein. A pair of coacting upper and lower guide grooves 58, 60, respectively, are defined in the entrance hole 52 and the base plate 48, respectively, for each socket 50. The guide grooves 58, 60 have confronting surfaces converging so as to gradually reduce the respective grooves 58, 60 in depth toward the corresponding locking holes 54, 56.

Second attachment member 18 is a strip 62 with a plurality of plugs 64 extending therefrom. Each of the plugs 64 includes enlarged heads 66 at their tip. The plugs 64 are aligned along strip 62 in correspondence with sockets 50 on base plate 48. Thus, when the first and second attachment members 16, 18 are pressed together, plugs 64 are guided within guide grooves 58, 60 so that heads 66 are aligned with sockets 50 and enter entrance holes 52 and resiliently deform sockets 50. When pressed far enough, heads 66 enter upper and lower locking holes 54, 56 allowing the sockets to return to their normal configuration and thereby lock the heads 64 into sockets 50, causing the first and second attachment members 16, 18 to be releasably locked or attached together.

Figure 6:
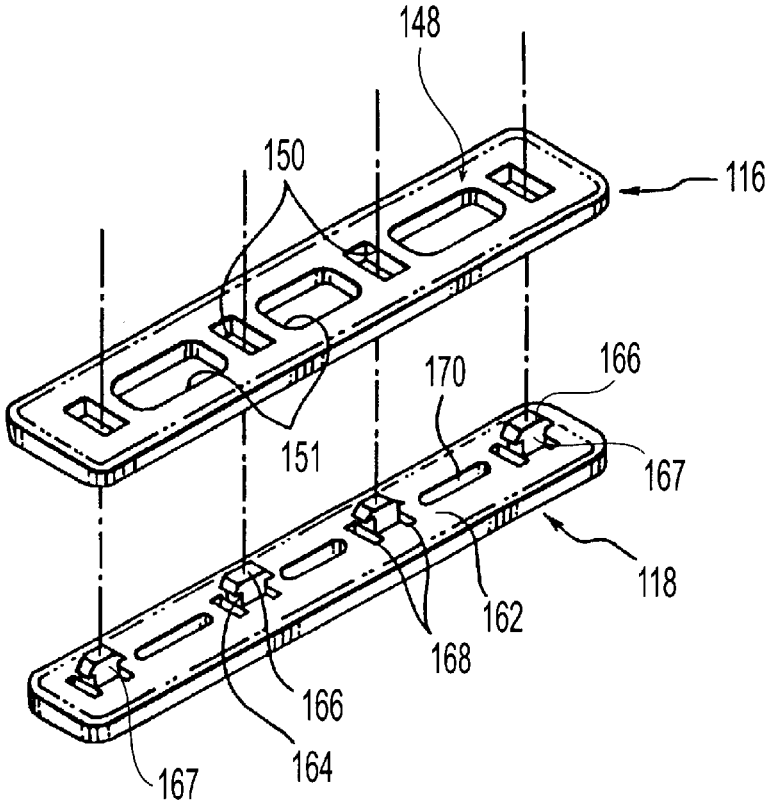
FIG. 6 is an exploded perspective view of a different embodiment of the attachment members of FIG. 5.

FIG. 6 shows an alternate embodiment of the first and second attachment members 116, 118, respectively. First attachment member 116 is in the form of a rectangular strip 148 molded of the same material as that of the attachment member 16 and has a plurality of laterally elongated rectangular sockets or slots 150 longitudinally arranged at a predetermined distances, and a plurality of apertures 151 disposed longitudinally on rectangular strip 148 and centrally located between the slots 150. The apertures 151 increase the resilience of rectangular strip 148.

Second attachment member 118 includes a rectangular base 162 and has a plurality of longitudinally arranged plugs 164 at positions corresponding to the slots 150 of the first attachment member 116. Each plug 164 is substantially T-shaped and has a trapezoidal engaging head 166 located atop a stem portion 167, which allows each plug 164 to be removably engaged in one of the slots 150. A pair of elongated slits 168 is formed in strip 162 adjacent each plug 164 and a plurality of elongated apertures 170 are formed between each adjacent pair of plugs 164 to increase the resilience of strip 162.

When the first attachment member 116 is pressed against second attachment member 118, trapezoidal engaging heads 166 of plugs 164 are received in the slots 150 of first attachment member 116, thereby securing interlocking engagement between the first and second attachment members 116, 118.

Referring to FIGS. 2, 5–6, if the glove body 12 and tab 14 need to be separated for some reason, such as to replace tab 14 with a different tab 14' having a different logo or design D', the first and second attachment members 16, 18 or 116, 118 can be separated from one another relatively simply by pulling them away from each other, causing the sockets 50, 150 in each first attachment member 16, 116 to resiliently deform and release the heads 66, 166 of each second attachment member 118 therefrom. Tab 14 may then be replaced with a different tab 14' having a different design or logo D' thereon.

Figure 7:
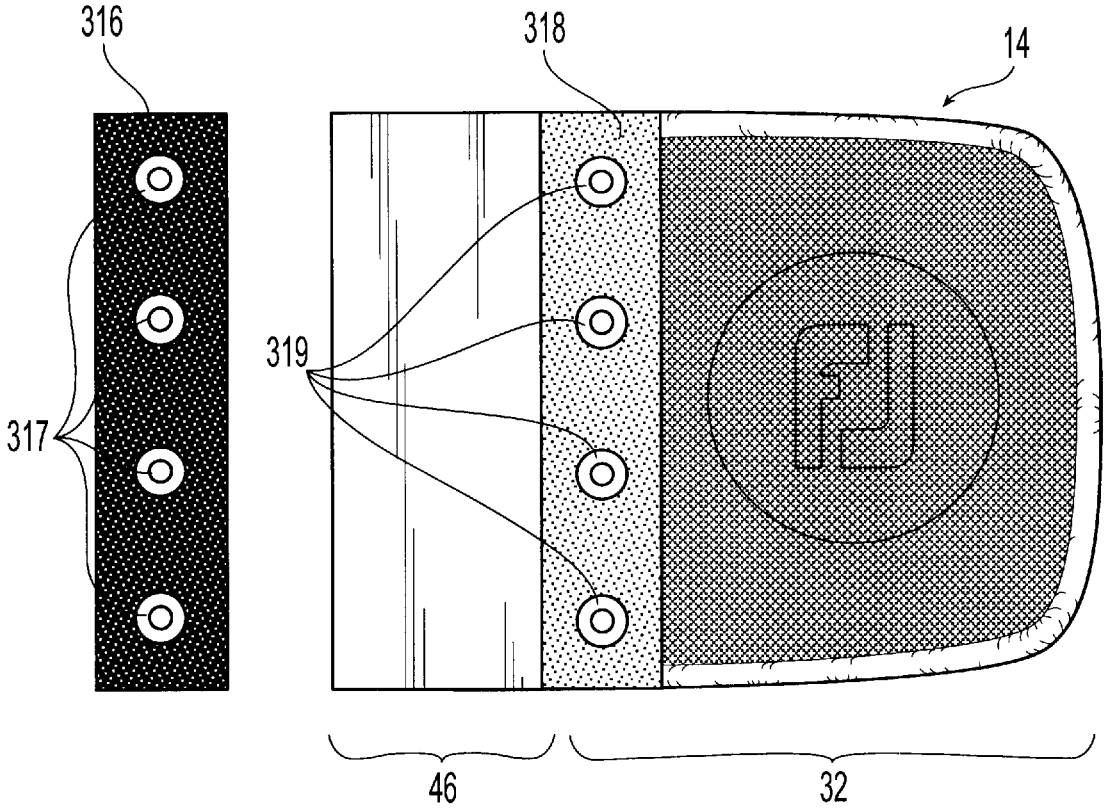
FIG. 7 is an exploded top view of yet another embodiment of the attachment members of FIG. 5

FIG. 7 shows yet another embodiment of the first and second attachment members 316, 318, respectively, which are in the form of corresponding male and female snaps 317, 319, respectively. When pressed together, each male snap 317 is received by the corresponding female snap 319 and resiliently locked thereto, thereby securing tab 14 to the glove body 12. When pulled apart with sufficient force, the corresponding pairs of snaps 317, 319 deform and separate from one another, thus permitting separation of tab 14 from glove body 12.

Referring to FIGS. 8–11, a second embodiment of a glove 210 according to the present invention is shown. Similar to glove 10, discussed above, glove 210 includes a glove body 212 and a tab 214 removably attachable to glove body 212 by first and second attachment members 216, 218, shown in detail in FIGS. 9 and 10. Tab 214 has a logo or design D thereon.

Figure 8:
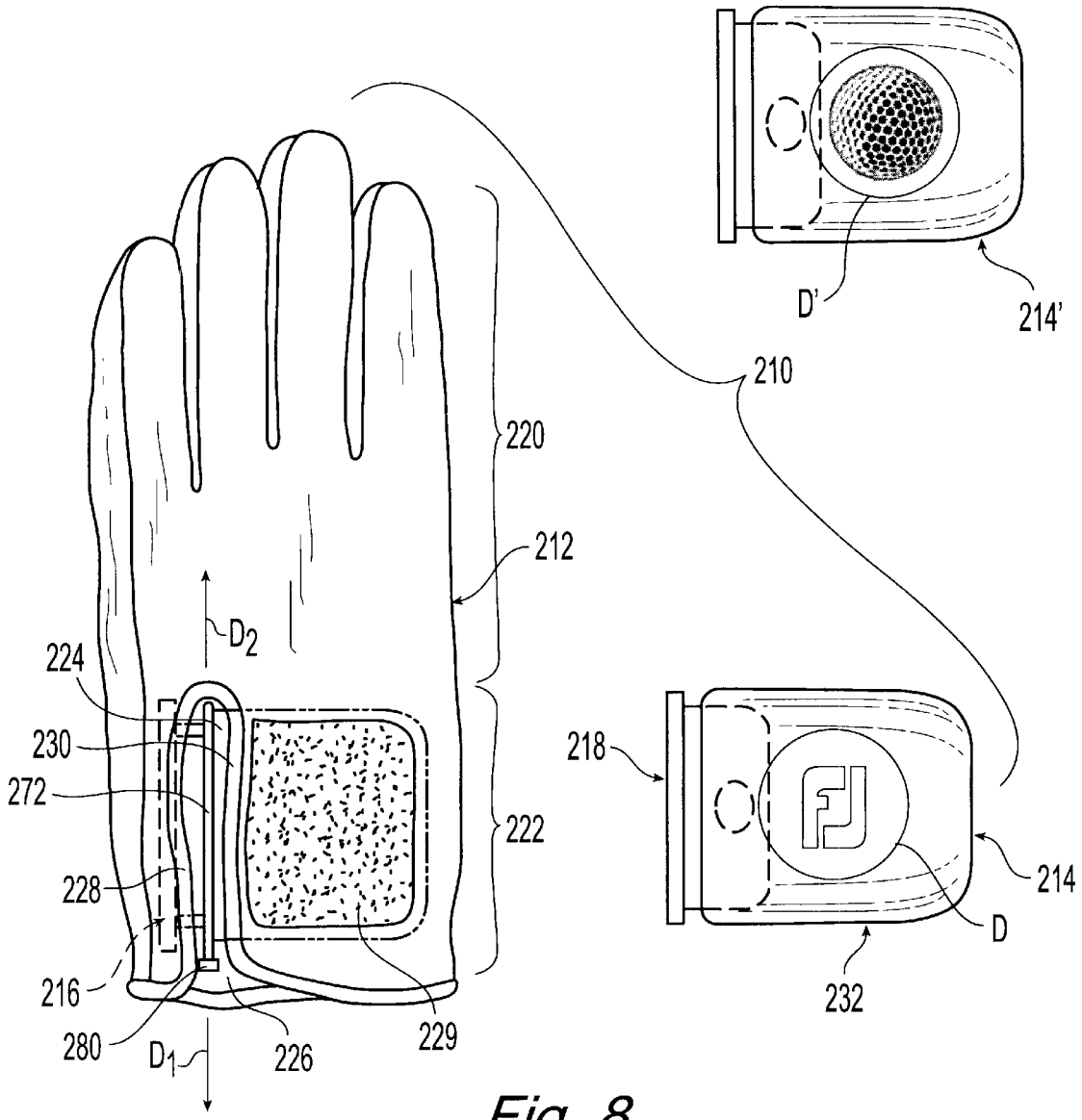
FIG. 8 is an exploded top view of a glove according to a second embodiment of the present invention.
Figure 9:
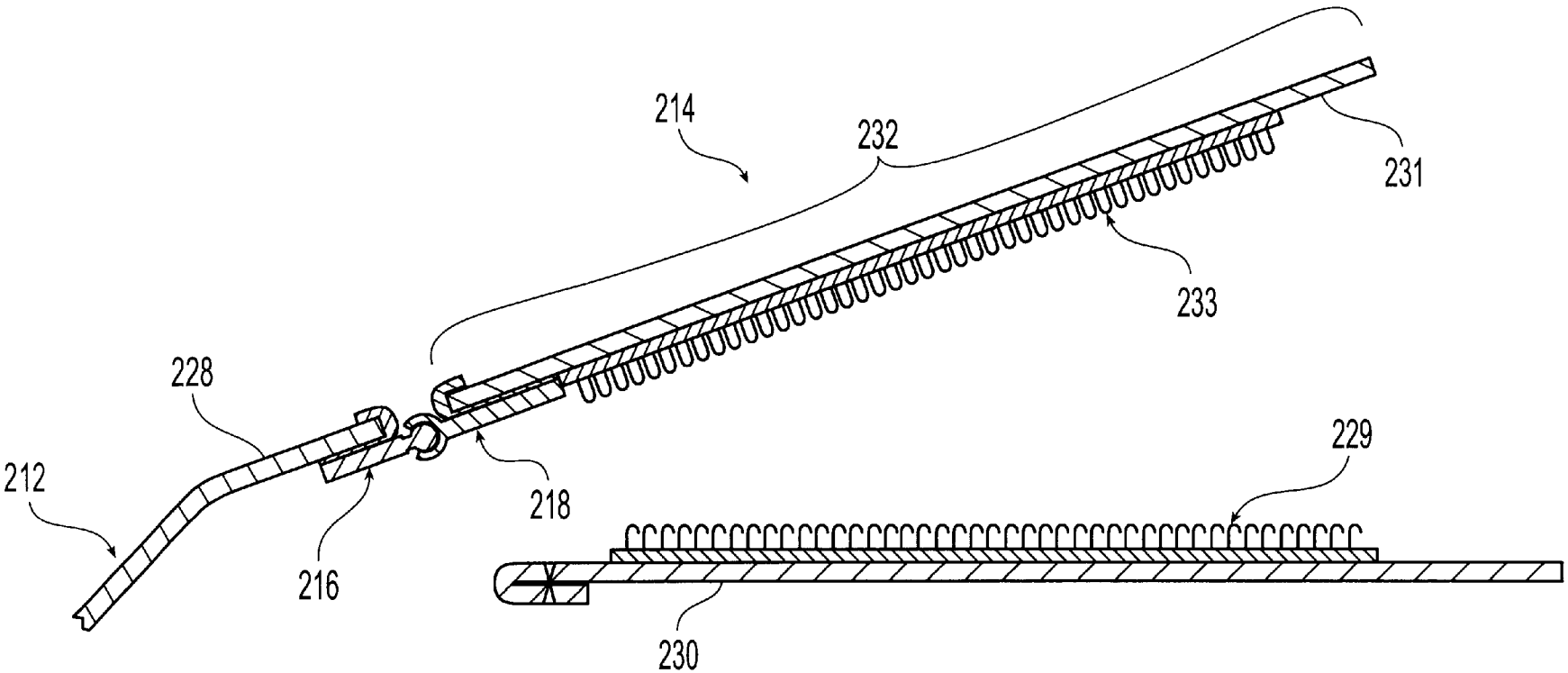
FIG. 9 is a cross-sectional view of a portion of the glove and fastener material of FIG. 8, wherein the fastener material is attached to the glove.

Glove body 212 has a wrist portion 222 with a slit 224 therein extending from an open end 226 toward the upper portion 220 of the glove body 212. Slit 224 has a first side 228 and a second side 230. As shown in FIGS. 8 and 9, tab 214 can be attached to glove body 212 adjacent the first side 228 of slit 224, and a second fastener piece 229 may be located on an upper surface of wrist portion 222 adjacent the second side 230 of slit 224. Tab 214 has a flap portion 232 that folds over slit 224 such that a lower surface 231 of flap portion 232 may contact the second side 230 of slit 224. The lower surface 231 of flap portion 232 preferably has a first fastener piece 233 attached thereto for removable attachment to second fastener piece 229.

Figure 10:
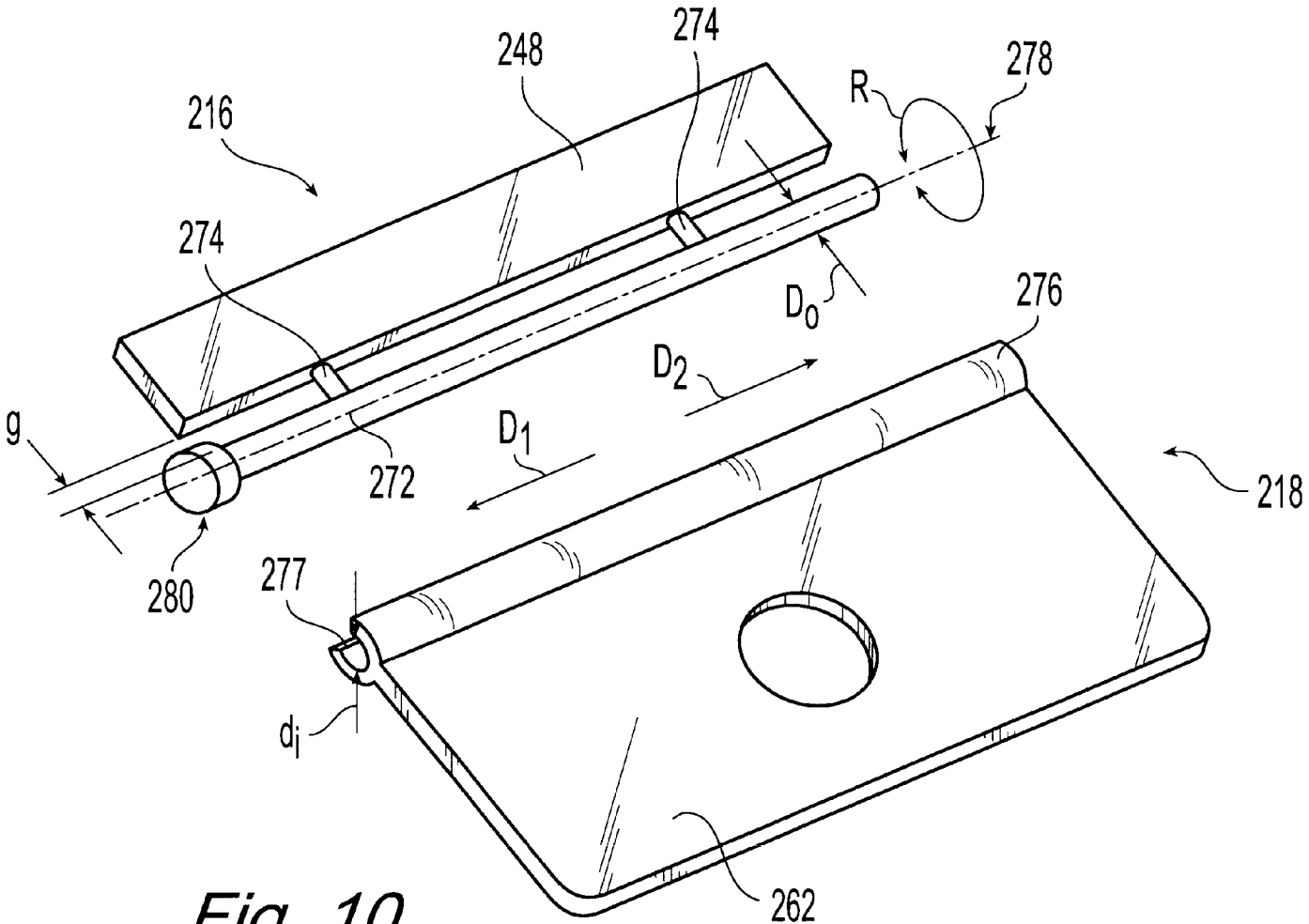
FIG. 10 is an exploded perspective view of first and second attachment members of the glove of FIG. 8.

Referring to FIGS. 9 and 10, first and second attachment members 216, 218 may be molded of thermoplastic synthetic resin, such as polyethylene, polypropylene, polyamide or polyester and are typically attached to the glove body 212 and tab 214 by stitching. Alternatively, the attaching may be accomplished by ultrasonic welding, thermal welding or by adhering with an adhesive.

First attachment member 216 includes a generally rectangular base plate 248 having an internal longitudinal coupling member, or rod 272, attached thereto by standoffs 274. Standoffs 274 are protrusions or extensions that couple rod 272 to base plate 248 and preferably provide a small separation or gap g between base plate 248 and rod 272, as shown in FIG. 10. While FIG. 10 shows only two standoffs 274, any number of standoffs may be used, or alternatively, one standoff spanning the entire length of rod 272 may be used to attach rod 272 to base plate 248. Referring to FIG. 8, first attachment member 216 is positioned on one side of slit 224 so that rod 272 is oriented parallel to slit 224 and extends partially into the slit.

Second attachment member 218 includes a rectangular base 262 with a longitudinal receiving member, or sleeve 276, attached thereto for receiving rod 272. Sleeve 276 has a longitudinal slit 277 therein to allow sleeve 276 to slide with respect to rod 272 and there over and retain the two parts together in a direction substantially transverse to longitudinal axis 278. One of ordinary skill in the glove art will know and appreciate that the positions of rod 272 and sleeve 276 maybe switched, for example, such that rod 272 is located on the second attachment member 218 and sleeve 276 is located on the first attachment member 216. Rod 272 and sleeve 276 may be further dimensioned and configured to allow sleeve 276 to rotate as illustrated by arrow R on rod 272 about longitudinal axis 278.

Rod 272 is shown in FIG. 10 as having a circular cross-sectional shape and sleeve 276 is shown having an inner diameter $d_i$ slightly larger than the outer diameter do of rod 272, allowing sleeve 276 to slide over rod 272 and rotate thereon. Rod 272 may alternatively have a different cross-sectional shape, such as square, rectangular or triangular, and still allow sleeve 276 to rotate thereon, or rod 272 may be in the form of an inner sleeve that is dimensioned to be received in sleeve 276. In addition, sleeve 276 may have a cross-sectional shape that does not match rod 272 to prevent sleeve 276 from rotating thereon.

A stop 280 may optionally be formed on either the rod 272 or the sleeve 276 to prevent sliding of the two attachment members 216, 218 with respect to one another in a predetermined direction D1 along axis 278. For example, stop 280 is shown in FIG. 10 as an enlarged head formed on an end of rod 272, however the stop may alternatively be in the form of a closed end (not shown) at one end of sleeve 276. As shown in FIG. 8, stop 280 is preferably formed on rod 272 at the end nearest open end 226 of slit 224. Alternatively stop can be repositioned at the other end of rod 272 to prevent movement in direction D2, shown in FIG. 10.

Referring to FIG. 8, glove 210 permits the tab 214 to be easily removed from glove 210 by sliding tab 214 parallel to slit 224 in direction D2, away from stop 280, until sleeve 276 disengages rod 272. Tab 214 can then be replaced with a different tab 214' having a new design or logo, shown in FIG. 8, by sliding sleeve 276 back onto rod 272 in direction D1, until sleeve 276 contacts stop 280.

Figure 11:
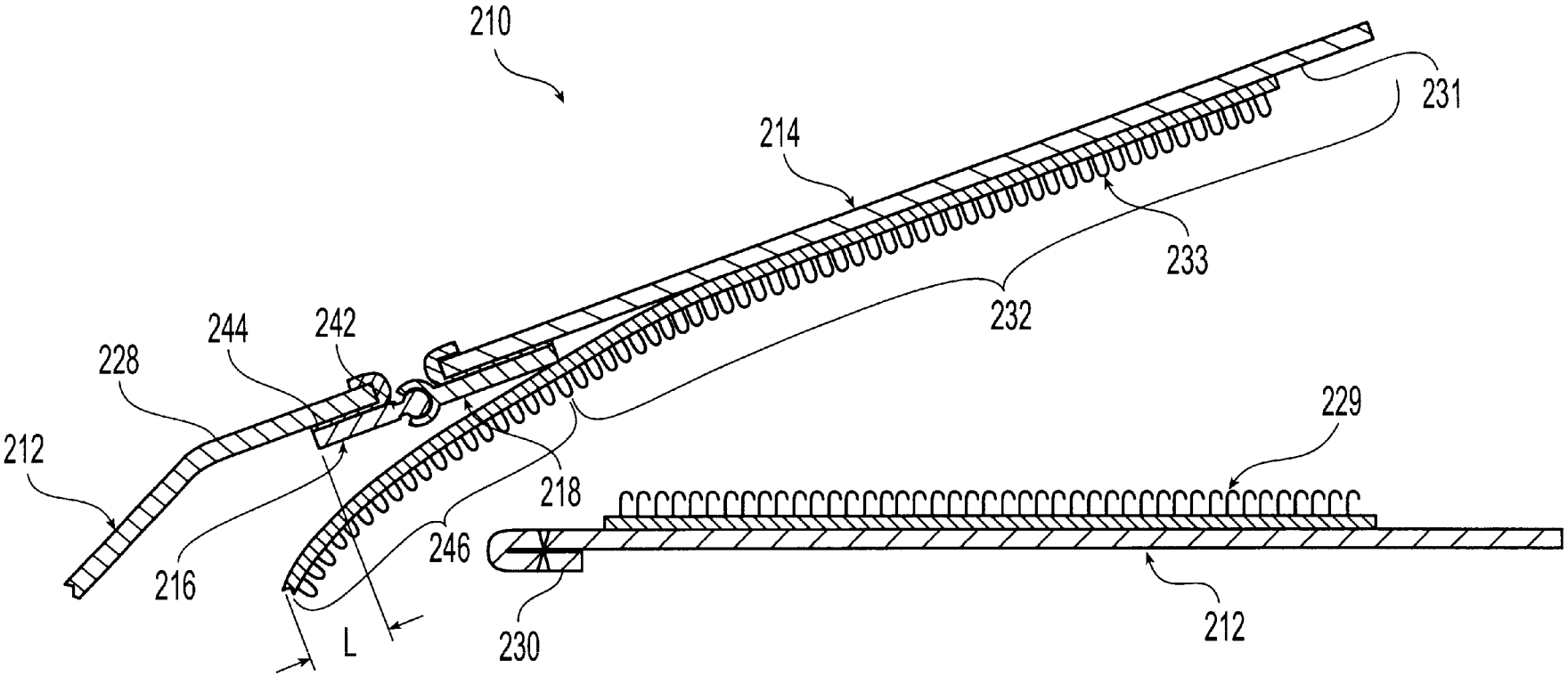
FIG. 11 is a cross-sectional view of a portion of a modified version of the glove and faster material of FIG. 8, wherein the fastener material is attached to the glove.

FIG. 11 shows a variation of tab 214 that includes a flap portion 232 and an extended portion 246. Extended portion 246 extends from a slit side 242 of first attachment member 216, covers first attachment member 216 and then extends substantially beyond an interior side 244 thereof, by a length L. Tab 214 thus covers the attachment members 216, 218 and at least partially blocks them from contacting the wearer's skin (not shown).

Preferably, length L is at least about 0.25 inches, more preferably between about 0.25 and about 1 inches, and most preferably at least about 1 inch.

As shown in FIG. 11, extended portion 246 and second fastener piece 233 may be formed of a single piece of hook-and-loop material attached to flap portion 232. The increased length L of second fastener piece 233 increases the adjustability of the wrist portion 222 of glove 210. Alternatively, tab 214, flap portion 232 and extended portion 246 may be a single piece of material, such as hook-and-loop material. According to one alternate embodiment, extended portion 246 can be a separate piece of material, such as fabric, leather or felt, that is coupled to the glove 210, first attachment member 216, or tab 214 with adhesive or stitching. According to yet another alternative embodiment, extended portion 246 can be layered between the second fastener piece 233 and the tab 214, however, one of ordinary skill in the glove art will know and appreciate than any number of different configurations, materials, and attachment techniques may be utilized to form extended portion 246.

Figure 12:
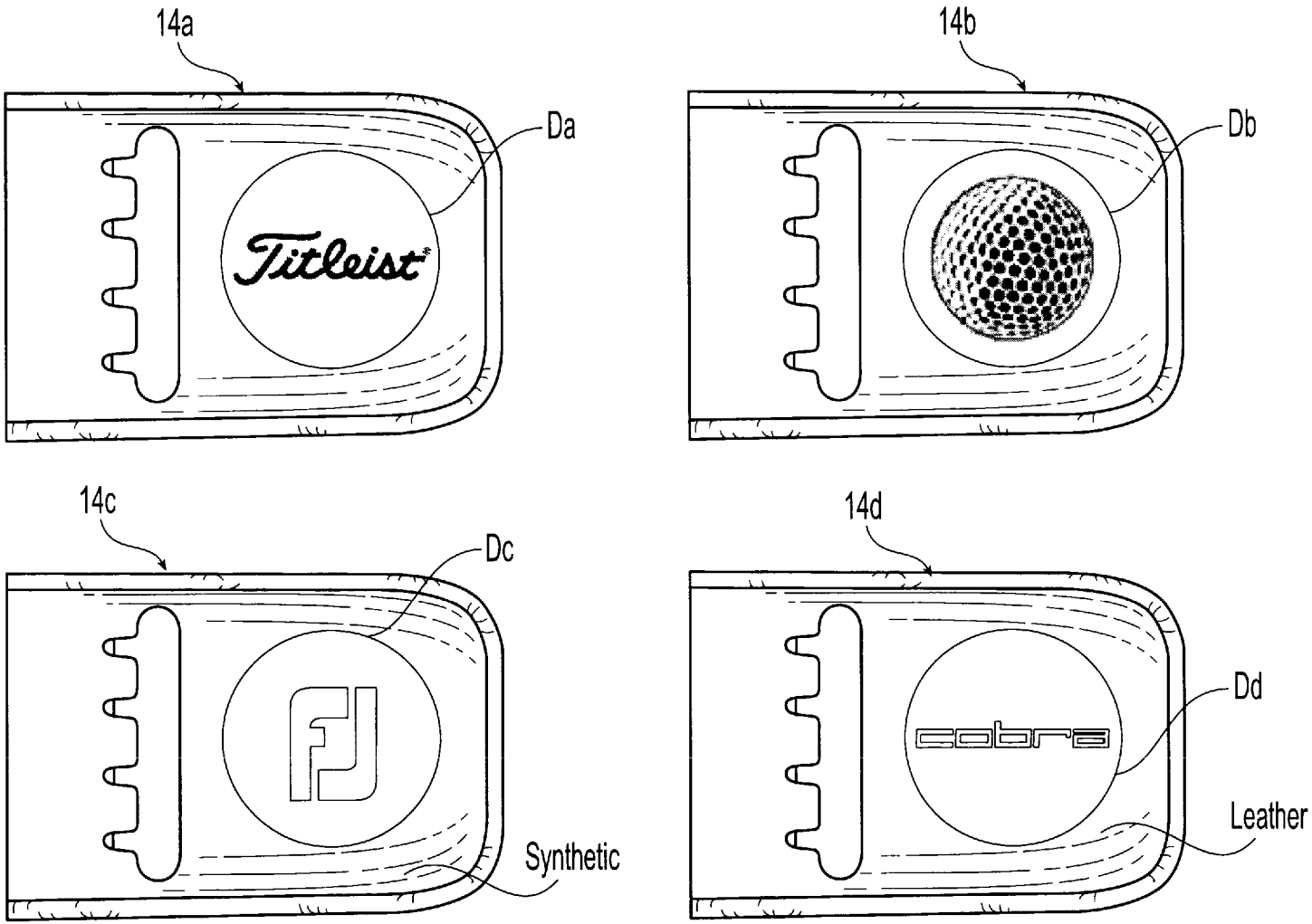
FIG. 12 is a top view of a set of fastener material having different properties.

FIG. 12 shows a set of tabs 14a-d for use with glove 10. Each of the tabs 14*a–d* has a different logo or design Da-d thereon, or a different set of properties such as indicia, colors, materials, or patterns. A similar set of tabs may be provided having an attachment member for use with glove 210.

While the above invention has been described with reference to certain preferred embodiments, it should be kept in mind that the scope of the present invention is not limited to these embodiments. For example, the materials and fasteners can be used on other garments, shoes, articles, bags and the like. The embodiments above can also be modified so that some features of one embodiment are used with the features of another embodiment. It is intended that the appended claims cover all such modification and embodiments as fall within the true spirit and scope of the present invention.

What is claimed is:

1. A glove, comprising:

a body with a slit therein;

a first attachment member attached to the body adjacent the slit and having a slit side and an interior side; and a first piece of material having an extended portion, the first piece of material further including a second attachment member attached thereto for attachment to the first attachment member, wherein upon attachment the extended portion extends from the slit side of the first attachment member substantially beyond the interior side of the first attachment member;

wherein one of the attachment members includes a rod oriented substantially parallel to the slit and the other attachment member includes a sleeve slidable over the rod for attaching the attachment members together.

2. The glove of claim 1, wherein the rod defines a longitudinal axis and the attachment members are rotatable with respect to one another about the longitudinal axis.

3. The glove of claim 1, wherein one of the attachment members further includes a stop disposed thereon to prevent the sleeve from sliding longitudinally along the rod in a predetermined direction.

4. A glove, comprising:

a body having a slit therein;

a first attachment member attached to the body adjacent the slit; and a first piece of material having a second attachment member for removable attachment to the first attachment member, wherein one of the attachment members includes a rod oriented substantially parallel to the slit and the other attachment member includes a sleeve that is slidably coupled to the rod for attaching the attachment members together;

wherein the rod defines a longitudinal axis and the attachment members are rotatable with respect to one another about the longitudinal axis.

5. A glove, comprising:

a body having a slit therein;

a first attachment member attached to the body adjacent the slit; and a first piece of material having a second attachment member for removable attachment to the first attachment member; wherein one of the attachment members includes a rod oriented substantially parallel to the slit and the other attachment member includes a sleeve that is slidably coupled to the rod for attaching the attachment members together;

wherein one of the attachment members further includes a stop disposed thereon to prevent the sleeve from sliding longitudinally along the rod in a predetermined direction.

6. A glove, comprising:

a body having a slit therein;

a first attachment member attached to the body adjacent the slit; and a first piece of material having a second attachment member for removable attachment to the first attachment member; wherein one of the attachment members includes a rod oriented substantially parallel to the slit and the other attachment member includes a sleeve that is slidably coupled to the rod for attaching the attachment members together;

wherein the first attachment member includes the sleeve and the second attachment member includes the rod.

7. The glove of claim 6, wherein a stop is disposed on one end of the rod to prevent the sleeve from sliding in a predetermined direction.

8. A glove, comprising:

a body having a slit therein;

a first attachment member attached to the body adjacent the slit; and a first piece of material having a second attachment member for removable attachment to the first attachment member; wherein one of the attachment members includes a rod oriented substantially parallel to the slit and the other attachment member includes a sleeve that is slidably coupled to the rod for attaching the attachment members together;

wherein the first piece of material further includes an extended portion, and the first attachment member has a slit side and an interior side, wherein the extended portion of the first piece of material extends from the slit side substantially beyond the interior side.

9. The glove of claim 8, wherein the extended portion extends beyond the interior side of the first attachment member by at least about 0.25 inches.

10. The glove of claim 8, wherein the extended portion extends beyond the interior side of the first attachment member by between about 0.25 inches and about 1 inches.

11. The glove of claim 8, wherein the extended portion extends beyond the interior side of the first attachment member by at least about 1 inch.

12. A glove, comprising:

a body having a slit therein;

a first attachment member attached to the body adjacent the slit; and a first piece of material having a second attachment member for removable attachment to the first attachment member; wherein one of the attachment members includes a rod oriented substantially parallel to the slit and the other attachment member includes a sleeve that is slidably coupled to the rod for attaching the attachment members together;

wherein the first piece of material further includes a flap portion having a first fastener piece, and the glove further includes a second piece of material located on the body, the second piece of material including a second fastener piece that is capable of being removably affixed to the first fastener piece.

* * * * *